US006383052B1

(12) United States Patent
McCarthy

(10) Patent No.: US 6,383,052 B1
(45) **Date of Patent: *May 7, 2002**

(54) SKIMMING DISK

(76) Inventor: Kevin McCarthy, 1125 205$^{th}$ Ave. NE., Redmond, WA (US) 98053

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/307,647

(22) Filed: May 7, 1999

Related U.S. Application Data

(60) Provisional application No. 60/084,527, filed on May 7, 1998.

(51) Int. Cl.[7] ..... A63H 23/00
(52) U.S. Cl. ..... 446/153; 446/46
(58) Field of Search ..... 446/46, 153, 236, 446/255; 473/587, 588, 589, 596

(56) References Cited

U.S. PATENT DOCUMENTS

| | | | | |
|---|---|---|---|---|
| 4,151,997 A | | 5/1979 | Glovak et al. | |
| 4,205,484 A | * | 6/1980 | Kovac et al. | 446/46 |
| 4,212,462 A | | 7/1980 | Glovak et al. | |
| 4,463,954 A | | 8/1984 | Panse et al. | |
| 4,553,758 A | | 11/1985 | Zehr | |
| 4,979,922 A | | 12/1990 | Clark | |
| 5,348,509 A | | 9/1994 | Riccardi et al. | |
| 5,358,440 A | | 10/1994 | Zheng | |
| 5,366,403 A | | 11/1994 | Weiss | |
| 5,423,705 A | | 6/1995 | Solomon, II | |
| 5,433,637 A | | 7/1995 | Graves | |
| 5,484,159 A | | 1/1996 | Dean et al. | |
| 5,531,624 A | | 7/1996 | Dunipace | |
| 5,540,610 A | | 7/1996 | Sneddon | |
| 5,679,082 A | * | 10/1997 | Hincke | 473/588 |
| 5,836,840 A | * | 11/1998 | Bustamante et al. | 473/588 |

* cited by examiner

*Primary Examiner*—Sam Rimell
(74) *Attorney, Agent, or Firm*—Kimberly A Chasteen

(57) ABSTRACT

An aquatic device for skimming across the surface of a body of water is provided. The device includes a centrally located body section, a bridge extending from the body section, a grip handle having an outer side wall, which extends from the bridge and is located about the periphery of the device and a convex bottom surface. The body may be curved over its entire upper surface or may be flat across its upper surface and may include a downwardly and outwardly ramped perimeter. The bridge is thin enough to allow bending. The grip handle may be weighted for stability purposes and is designed to be grasped by a hand. The bottom surface is convex and meets the outer side wall at a sharp angle. The outer side wall is also convex. The device is constructed from materials such that it is heavy enough to overcome lift but light enough that it does not sink. The device may be made from one material having the required density or from two or more materials which act together to have the necessary density.

17 Claims, 9 Drawing Sheets

SKIMMING DISK

This Application Claims Priority To U.S. PROVISIONAL APPLICATION No. 60/084,527 Filed May ,7 1998.

BACKGROUND OF THE INVENTION

1. Technical Field of the Invention

The present invention relates generally to aquatic, surface skimming devices, and more particularly to a safer aquatic, surface skimming device designed for use in varying water conditions.

2. Discussion of the Related Art

The beach activity of throwing flat round stones, sand dollars, or sea shells, in a manner in which causes the flat round projectile to rotate on a center axis, which can either take flight or be skipped over the surface of the water, is an ageless and timeless activity fascinating both young and old since antiquity. The airborne activity of sailing stones and sea shells has been modernized to what is now known as Frisbee throwing, that is, the gyroscopic propelling of an aerodynamically contoured plastic flying disk.

The large market for flying disks, such as frisbees, has been established because the products offer the consumer, not only fun and exercise, but a fascinating experience with the laws of gyroscopic aerodynamics which far surpass the common experience of sailing stones or shells. Though made of semi-rigid materials, they are lightweight and feature a smooth bulbous perimeter.

Most people have experienced skipping stones on the water. People enjoy the excitement of a well-skipped stone because it seems to defy natural law. However, rocks are skipped out over open water away from people. Unlike the sea shell's successful transformation to plastic flying disk, the activity of skipping stones on the water has yet to evolve into a higher performing, practical and popular commercial alternative. One could conclude, that the success of a manufactured water skimming device, which could travel long distances on the water, would depend on the consumer experiencing a fascination with a new physical phenomena while experiencing a significant degree of security about the softness of the product.

One significant drawback of other aquatic devices is that they exhibit significant hydrodynamic drag due to a beveled or radiused lower edge. Non-gyroscopic hydrodynamic planing, such as with boats, requires a contoured leading edge and a sharp trailing edge. Previous inventors have assumed that a contour or beveled angle of some sort is desirable at the leading edge of a disk to break the water, as is proven in boat design. As seen in this previous design, radial contours between the bottom surface and side wall allow water to continue up the side wall and break loose above the normal water level, especially at moderate to slower speeds of the disk. Any bevel or radiused edge at the running surface perimeter will draw water and pull the disk down below the air water interface, thus causing drag.

Another significant drawback of these inventions is that substantial force is transferred through the leading edge of the disk when it makes contact with another person or object. Though not mentioned in these other inventions, soft or low density foam can't be used alone to cushion the sides of the disk effectively because it is hydrodynamically unstable. Furthermore, soft foam alone squishes too easily when gripped and is too flexible for controlled throwing or passing of the disk. Using lightweight foam can limit the total weight of the disk, thus reducing momentum and subsequent distance. Also, lightweight foam has less mass and material, and therefore is not as durable. If the product wears or tears, the geometry changes and effects performance.

Still, another important drawback of the previous designs is that a pressure grip is required in throwing the disk. Because the disk is wet, often times a secure grip is difficult to achieve because shear tension between the hand and the disk develops when centrifugal forces occur in the throwing motion. These older inventions show a tapering from the center of the disk outwardly, encouraging the pressure grip of the hand to slide off the disk. Should such a disk be made of soft foam, it may be even harder to achieve a sufficient grip to maintain control during the throwing motion.

The patent to Richard G. Panse, U. S. Pat. No. 4,463.954, shows a water skimming device with a lower surface divided into two subsurfaces, a small central flat bottom surface transitioning or tapering to a more conical outer tapered surface surrounding that central bottom surface. In the various embodiments shown by Panse, the angle of taper or angle "alpha" between the central flat bottom and the surrounding tapered wall is always less than 30 degrees. The Panse design exhibits poor hydrodynamics because water is forced to change course from the flat area to the conical area at the trail edge because the angle of change is less than 45 degrees. Also, the Panse patent states that the bottom central flat surface is small as seen in FIG. 2 of the Panse drawings, possibly 30% or less of the diameter of the entire disk. Panse teaches an operative radius ratio of 0.5 and under. Based on the weight and size of the Panse invention, the small inner flat surface cannot support the disk for very long at the rate of speed prescribed. Panse verifies this by stating that his disk will travel only 25 feet, at 16 miles per hour at initial projection. After 20 or so feet, the speed of the disk slows and then the small inner surface cannot support the overall weight, thus the disk sinks slightly, causing drag on the conical outer surface. Testing revealed that if the radius ratio is less than 0.80, then the alpha angle is too small to effect proper water release at the trailing edge of the disk, thus producing unwanted drag. In FIG. 7 of Panse, a symmetrical device as viewed from a side elevation, featuring a dual surface bottom, vertical side walls, rounded corners and no handle is shown. Panse states that the subsequent distances obtained by his invention averaged about 20 feet, with all distances less than 25 feet.

The disk of Thomas L. Clark shown in U. S. Pat. No. 4,979,922 shows a common flying disk and an insert which is placed into the flying disk to adapt it to skipping across the water. Clark rightly shows a rounded lower outside edge on the flying disk in his drawings. For aerodynamic reasons, flying disks are molded from a semi-rigid solid plastic, featuring an intentionally and purposefully rounded lower outside edge. The aerodynamics of the flying disk are enhanced by rounding this edge. Also, this edge is rounded because the user's hand firmly rubs across this surface each time the disk is thrown in the air. If flying disks were made with sharp lower rim edges they would cut, blister, and chafe the user's fingers when used in the air without an insert. The addition of a Clark insert into a flying disk fits up against the inside edge of the rim, therefore leaving the rounded lower outside edge unchanged. For aerodynamic lift in flight, the Clark invention also shows a classic frisbee ellipsoidal arc profile with the leading edge being substantially below the horizontal center plane of the disk, not above. Additionally, Clark does not show a significant mechanical handle grip on the top side of his flying disk. Instead, Clark's invention shows a concave handle grip on the underside insert. The nature of Clark's design is the adaptation of a common flying disk, like the frisbee which requires a grip on the underside. Clark also states that his disk and insert are made from lightweight substantially rigid materials. This combination is operatively and practically ineffective.

The balance of other disk designs mentioned above are for improvements to a flying disk only, each of which are hollow on the underside.

It is accordingly an object of the present invention to provide an aquatic device which will travel great distances across the surface of a body of water.

It is another object of the present invention to provide an aquatic device which will function in rough water conditions.

It is another object of the present invention to provide an aquatic device which is designed to minimize the impact force of the device.

It is yet another object of the present invention to accomplish the foregoing objects in a simple manner.

Additional objects and advantages of the present invention are apparent from the drawings and specification which follow.

SUMMARY OF THE INVENTION

The present invention improves over the related art by significantly increasing both attainable distance and stability. The present invention has a larg and continuous spherical segment on its bottom surface. Further, the radius ratio between the bottom edge radius and the periphery radius is greater than 0.80, not less than as is shown in the related art. This invention, by exhibiting a radius ratio of over 0.80, has an angle between the bottom surface and the side wall surface of greater than 20 degrees, therefore producing improved water release from the trailing edge of the device. Additionally, the present invention includes an abrupt or sharp edge between the convex bottom sphere segment and the convex side wall segment. The invention described herein, with its unique features, if thrown at comparable speeds to those indicated in the related art, will travel an average distance of 75 feet with maximum distances of over 100 feet. The present invention skims the water surface effectively because it maximizes the planing area while minimizing drag or water resistance. This invention includes a large single running surface is superior to a multi-planer running surface as shown in previous designs. Further, this single running surface is a smooth continuous convex spherical segment, having a parabolic radius of 50" or more, and a chord height to length ratio of less than 0.02. While previous designs include bottom side handle grips, this grip design causes significant water flow disruption and causes poor performance. The present invention is sufficiently heavy to overcome lift and remain on the surface of the water and includes soft outer edges so as not to cause injury to an unwary person. These soft edges are required because this invention is 3 or 4 times the weight of a flying disk. Additionally, the present invention includes an impact absorption system to reduce the impact force should the device come in contact with something.

According to the present invention, the foregoing and additional objects are obtained by providing an aquatic device for skimming across the surface of a body of water which includes a centrally located body section, a bridge extending from the body section, a grip handle having an outer side wall, which extends from the bridge and is located about the periphery of the device and a convex bottom surface. The body may be curved over its entire upper surface, may be flat across its upper surface and may include a downwardly and outwardly ramped perimeter. The bridge is thin enough to allow bending, in the range of about 0.001 inches to 0.75 inches (0.00254 to 1.905 cm) and preferably about 0.125 inches to 0.75 inches (0.3175 to 1.905 cm) in thickness. The grip handle may be weighted for stability purposes and is between 0.1 and 1.5 inches (0.254 and 3.81 cm) in both thickness and in height and is preferably between 0.5 and 1.5 inches (1.27 and 3.81 cm) in both thickness and in height. The bottom surface has a parabolic radius of at least about 50 inches (127 cm) and the angle between the outer side wall and the bottom surface is between about 20 and 90 degrees. The bottom surface may be inset from the outer perimeter of the device. The outer side wall is convex and has a radius of between about 0.5 and 5 inches (1.27 and 12.7 cm). The device has an overall width to height ratio between about 4 to 1 and 24 to 1. The aquatic device is made from material such that the overall device has a composite density between 2 and 6 g/in$^3$ (0.122 and 0.366 g/cm$^3$). The device may be made from one material having this density or from 2 or more materials which act together to have a density in this range.

List of Elements

10 aquatic device

12 body

Figure 1:
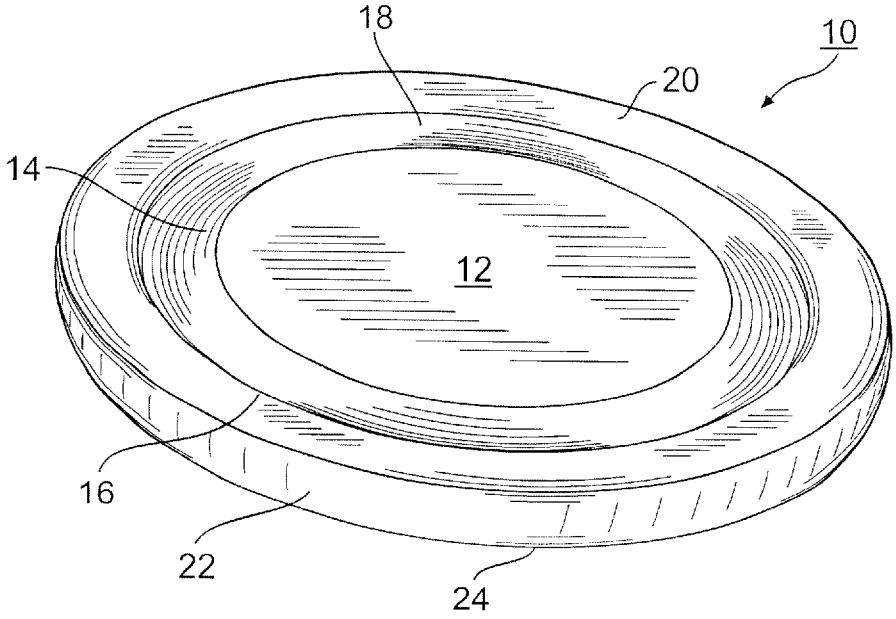
FIG. 1 is a perspective view of the present invention.
Figure 2:
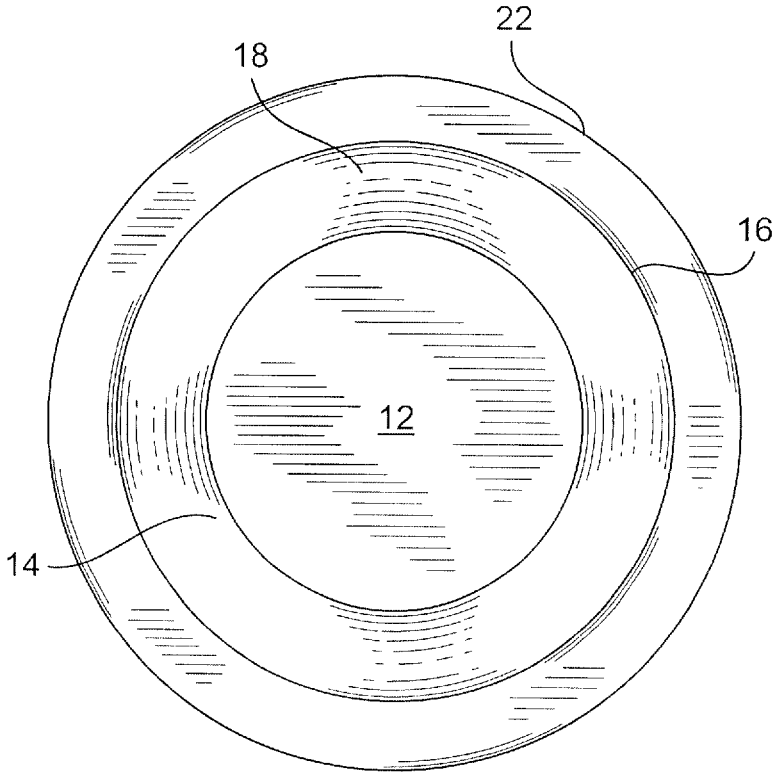
FIG. 2 is a top view of the present invention.
Figure 3:
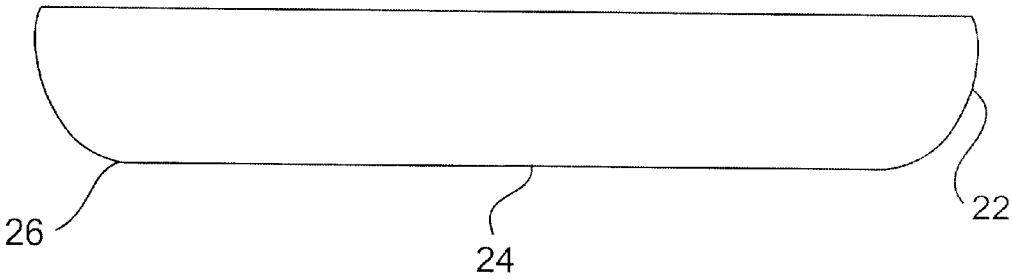
FIG. 3 is a side view of the present invention.
Figure 4:
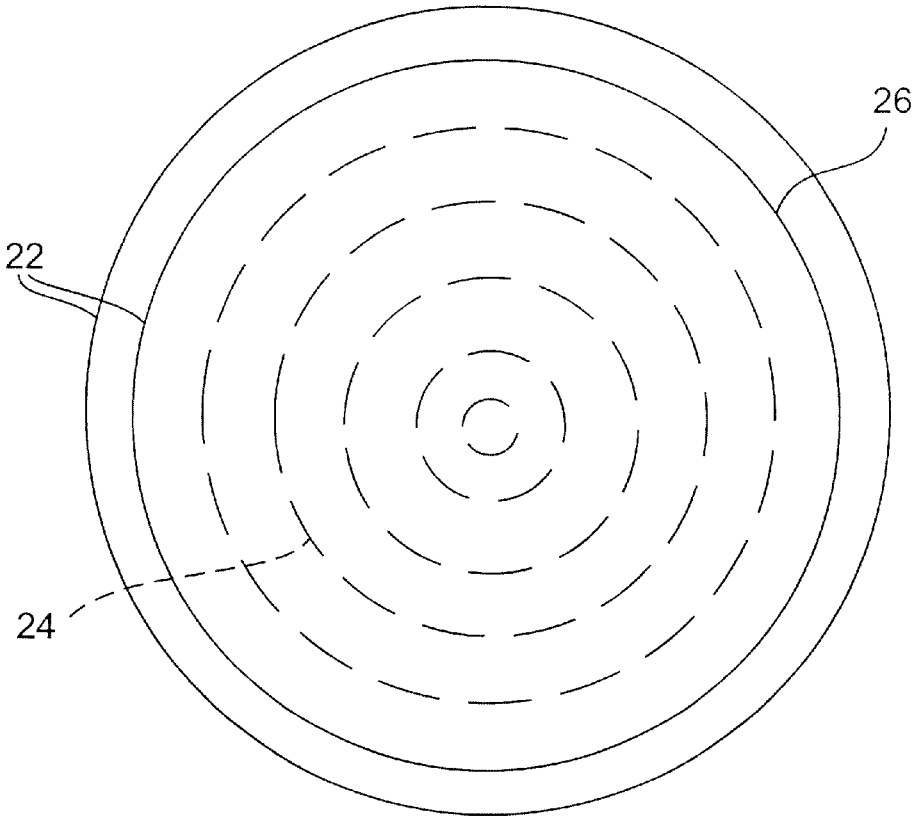
FIG. 4 is a bottom view of the present invention.
Figure 5:
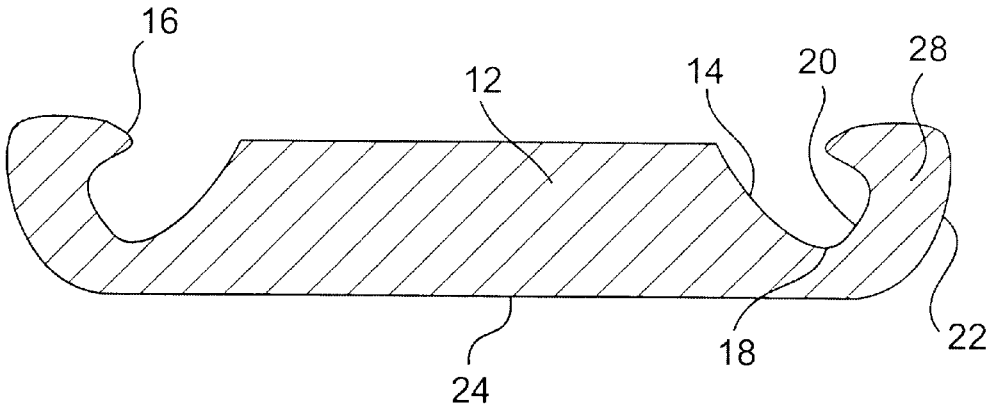
FIG. 5 is a cross-sectional view of the present invention.

14 ramp
16 cornice
18 bridge
20 cradle
22 outer side wall
24 bottom surface
26 intersection between outer side wall and bottom surface
28 grip handle
30 angle between outer side wall and bottom surface
32 soft, flexible outer covering
34 stiffening plate
36 secondary groove
38 multiple grooves
40 hard plate
42 rigid casing
44 offset step

DETAILED DESCRIPTION OF THE PREFERRED EMBODIMENT

FIGS. 1–5 show an aquatic device 10 according to the present invention. The aquatic device 10 consists of a body 12, a ramp 14, a cornice 16, a bridge 18, a cradle 20, an outer side wall 22 and a bottom surface 24. The central portion of the device is the body 10 which includes a downwardly and outwardly ramped perimeter 14 which connects to the bridge 18 of the device 10.

Figure 9:
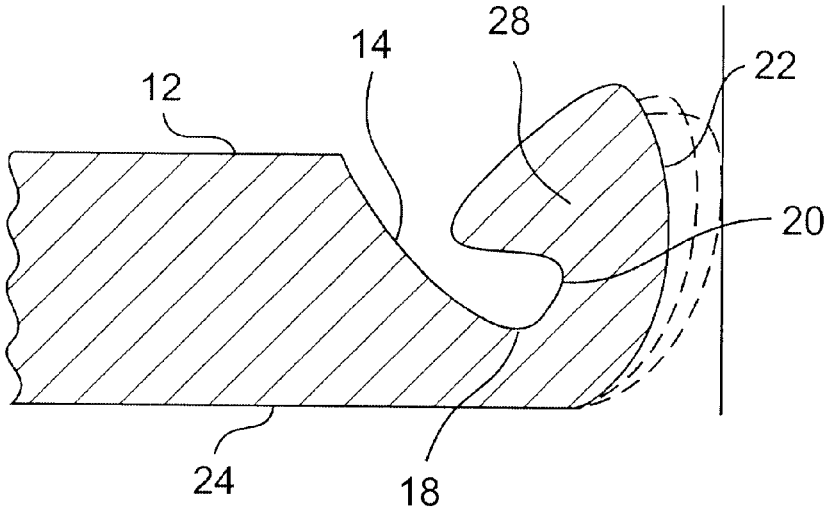
FIG. 9 is a partial cross-sectional view of the grip handle of the present invention.

The bridge 18 is generally between 0.125 and 0.75 inches (0.3175 to 1.905 cm) wide and is extremely thin, preferably in the range of 0.125 to 0.75 inches (0.3175 to 1.905 cm), to allow bending and compression of the device 10 at this point. The bridge 18 may be as thin as 0.001 inches (0.00254 cm) which would allow the grip handle 28 to ride on the surface of the water independently from the body 12 of the device 10 thus improving performance in rough water. The design of the bridge 18 allows the device 10 to absorb impact forces in the event the device 10 strikes a person or an object, as shown in FIG. 9.

The bridge 18 connects the body 12 of the device 10 to the grip handle 28 which consists of the cradle 20, the cornice 16 and the outer side wall 22. The device 10 is gripped along this grip handle 28 and thrown with the fingers grasping just inside the cradle 20. The grip handle 28 is generally between 0.1 and 1.5 inches (0.254 and 3.81 cm) in both thickness and in height, however the most comfortable grip handle 28 is between 0.5 and 1.5 inches (1.27 and 3.81 cm) in thickness and height. The outer side wall 22 is preferably convex and has a radius of between about 0.5 and 5 inches (1.27 and 12.7 cm), and preferably about 1.0 inch (2.54 cm). The grip handle may be weighted to provide additional stability to the device by minimizing the opportunity for lift to be initiated in choppy or rough water. This grip handle allows the user to maintain a stable compression grip with the fingers rather than the clamping grip used on previous designs. The compression grip prevents the disk from being prematurely released by the user while the clamping grip can be overcome prematurely by the centrifugal for imparted in the disk by the user. Additionally, the wet surface of an aquatic device reduces the frictional force between the user and the disk in a clamping grip. The compression grip of the present invention does not rely on friction to maintain a grasp on the device.

Figure 6:
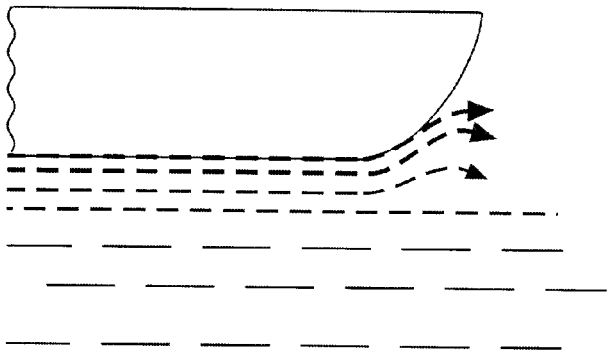
FIG. 6 PRIOR ART
FIG. 6 shows the water flow over the trailing edge of previous aquatic devices.
Figure 7:
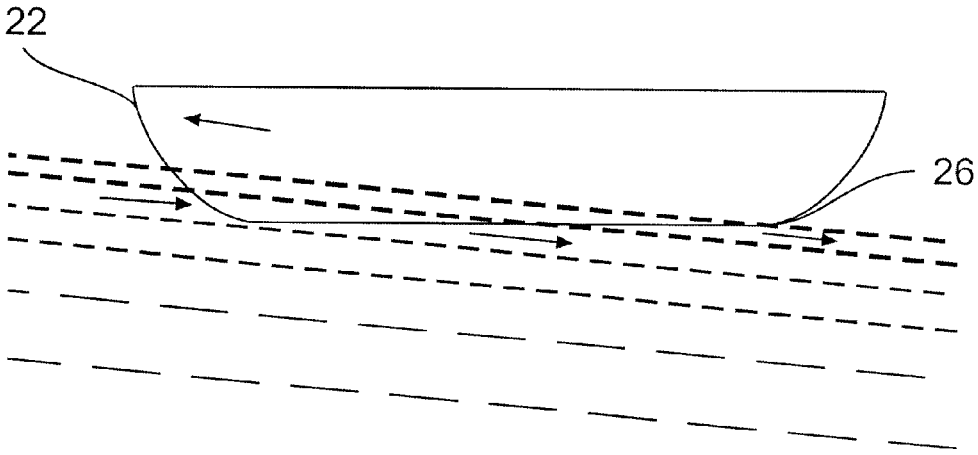
FIG. 7 shows the water flow over the trailing edge of the present invention.
Figure 8:
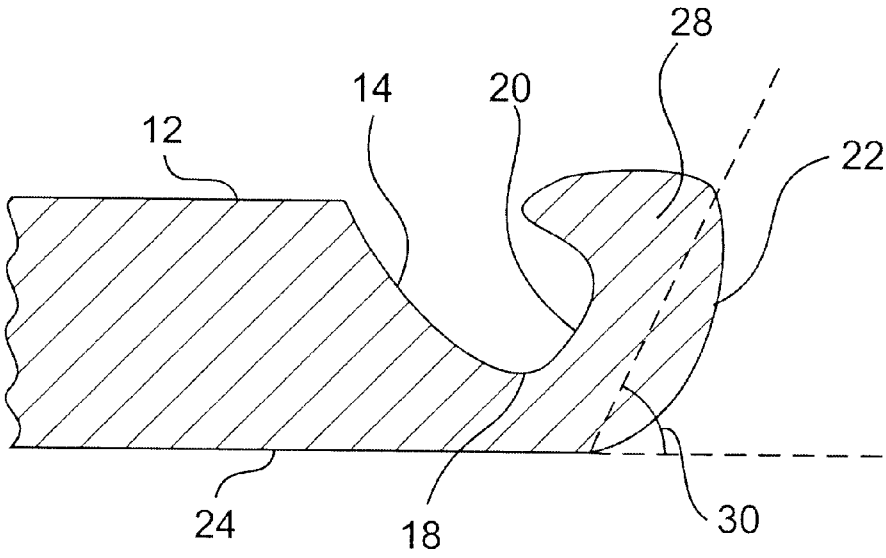
FIG. 8 is a partial cross-sectional view of the grip handle of the present invention.

Previous designs used a smooth contour to connect the outer side wall 22 to the bottom surface as shown in FIG. 6. This caused water to be drawn up along the outer side wall or the prior designs and caused drag thereby severely limiting the range of previous designs. In the present invention, the outer side wall 22 is connected to the bottom surface 24 at a sharp angle 30 (shown clearly in FIG. 8), preferably between 20 and 90 degrees when measured from outside the device 10. This sharp angle 30 enables the device 10 to ride over rough water along the leading edge and allows the trailing edge to break free from the surface tension caused by the contact between the device 10 and the water as shown in FIG. 7.

The bottom surface 24 is slightly convex, having a parabolic radius of at least 50 inches (127 cm) and the central or lowest point is preferably between 0.005 and 0.35 inches (0.0127 to 0.889 cm) below the intersection 26 between the bottom surface 24 and the outer sidewall 22.

The device 10 is generally circular in shape and is symmetrical with respect to a central axis of the device. The device 10 has an overall width to height ratio between 4 to 1 and 24 to 1. The device 10 may be made from soft plastic or rubber foam, solid thermoplastic rubber or thermistor rubber, or a composite of flexible and/or rigid materials. The density of the device is not conducive to flight and is preferably in the range of 2 to 6 g/in$^3$ (0.122 to 0.366 g/cm$^3$). Materials of higher density, in the range of 15 g/in$^3$ (0.915 g/cm$^3$), or having a specific gravity of approximately 1.00 may be used effectively provided that the total weight of the disk does not exceed approximately 30% of its displacement volume in water weight. Increased density may provide increased stability and momentum as the disk moves across the water, however, too great of a density forces the disk to sink to a level above the primary spherical running surface, thus causing excessive drag. Solid, high density designs may require the disk to be hollow on the inside to reduce the overall weight and ensure that the disk does not sink too far in the water.

Figure 17:
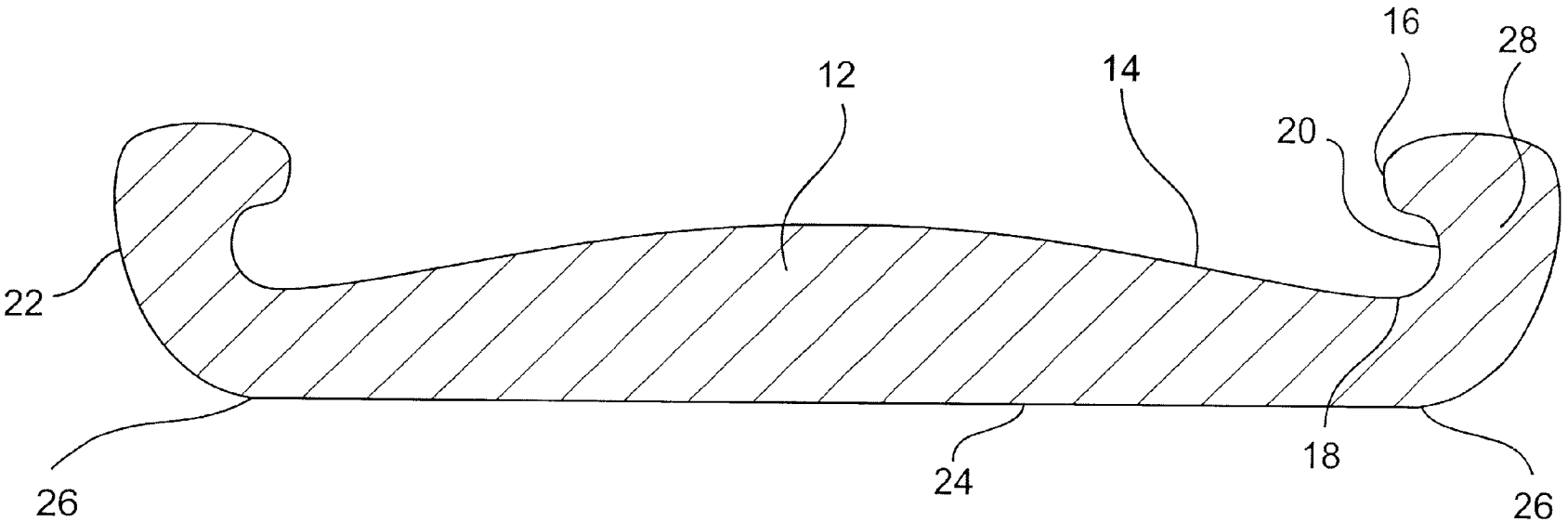
FIG. 17 shows a cross-sectional view of an alternate embodiment of the present invention.

A specific embodiment of the present invention as shown in FIG. 17 is now described. This embodiment of the device is made from soft urethane. The diameter of the device measures 9 inches (22.86 cm). The grip handle 28 and body 12 of the device are 1 inch (2.54 cm) in height and the grip 20 handle 28 is 1 inch (2.54 cm) wide. The bottom surface 24 is convex and has a parabolic radius of 100 inches (254 cm). The cornice 16 and outer side wall 22 are also convex and have radii of 0.75 inches (1.905 cm). The radius of the cradle 20 is 0.25 inches (0.635 cm). The volume of the device 10 is 50 cubic inches (819.35 cubic cm) and the weight is 8.82 oz (0.25 kg). This 25 device is capable of travelling 100 feet (30.48 m) or more.

Figure 10:
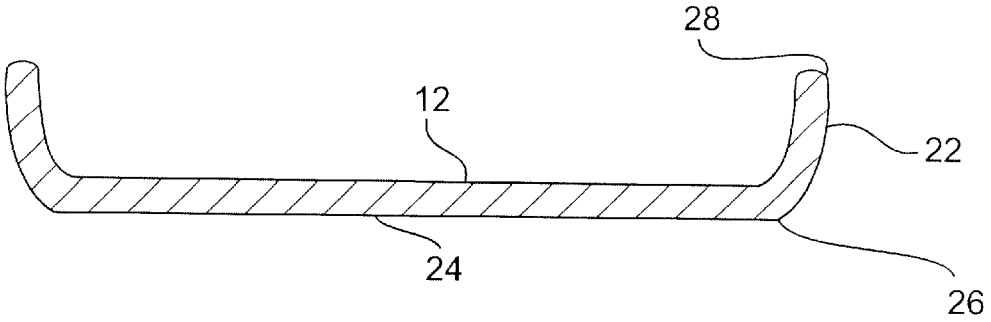
FIG. 10 shows a cross-sectional view of an alternate embodiment of the present invention.

Numerous alternate embodiments of the present invention are possible. FIG. 10 shows an embodiment having a very thin body section 12.

Figure 11:
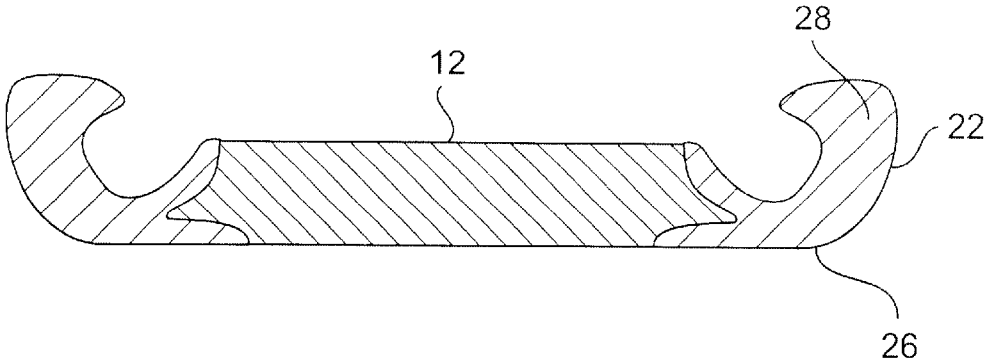
FIG. 11 shows a cross-sectional view of an alternate embodiment of the present invention.
Figure 12:
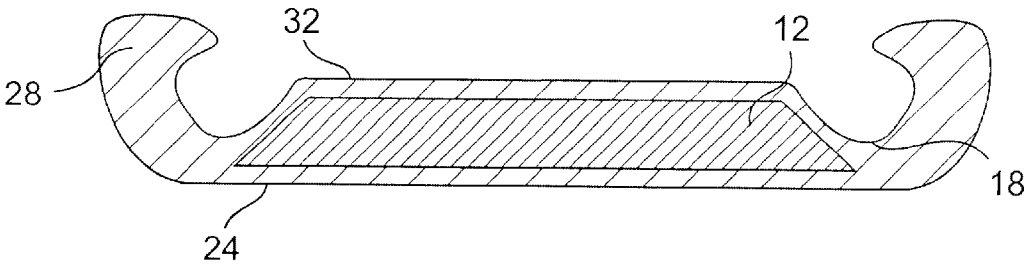
FIG. 12 shows a cross-sectional view of an alternate embodiment of the present invention.
Figure 13:
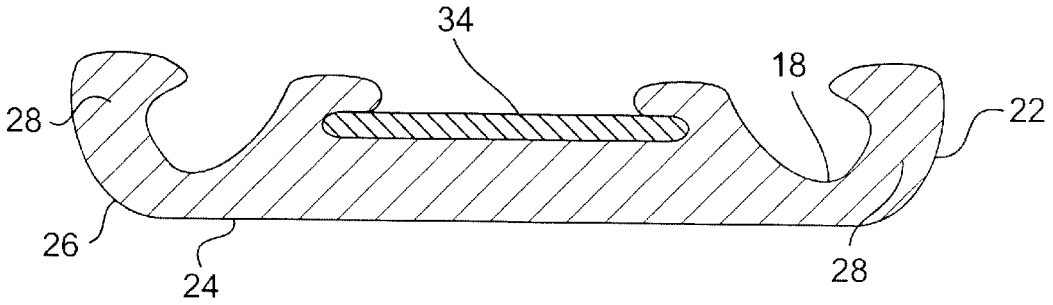
FIG. 13 shows a cross-sectional view of an alternate embodiment of the present invention.
Figure 14:
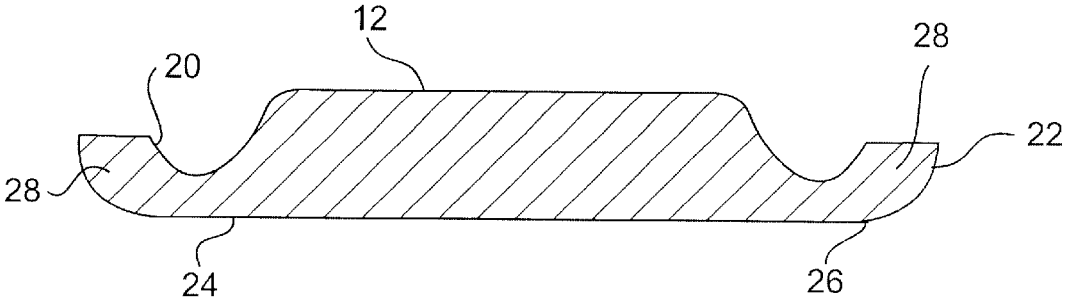
FIG. 14 shows a cross-sectional view of an alternate embodiment of the present invention.
Figure 15:
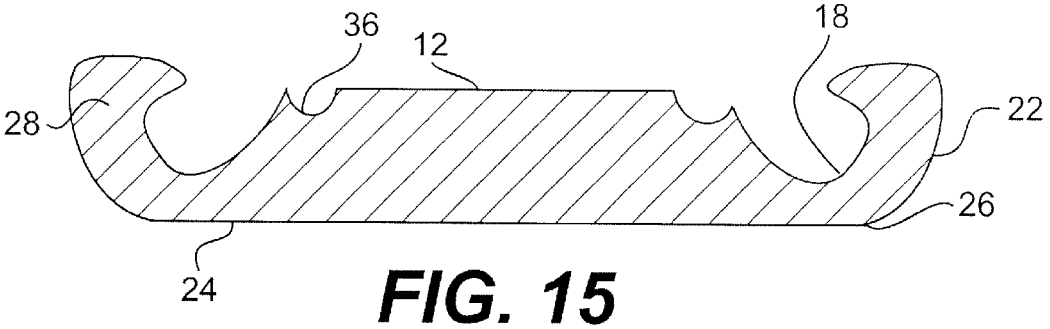
FIG. 15 shows a cross-sectional view of an alternate embodiment of the present invention.
Figure 16:
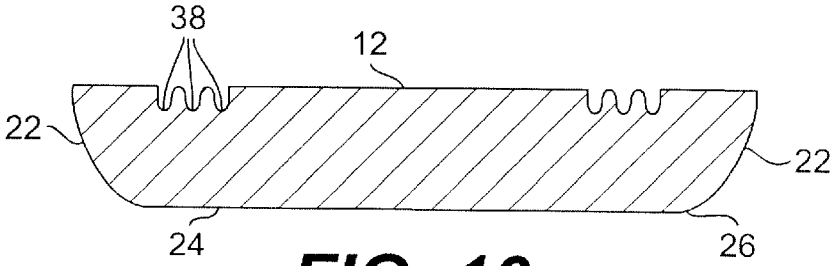
FIG. 16 shows a cross-sectional view of an alternate embodiment of the present invention.
Figure 18:
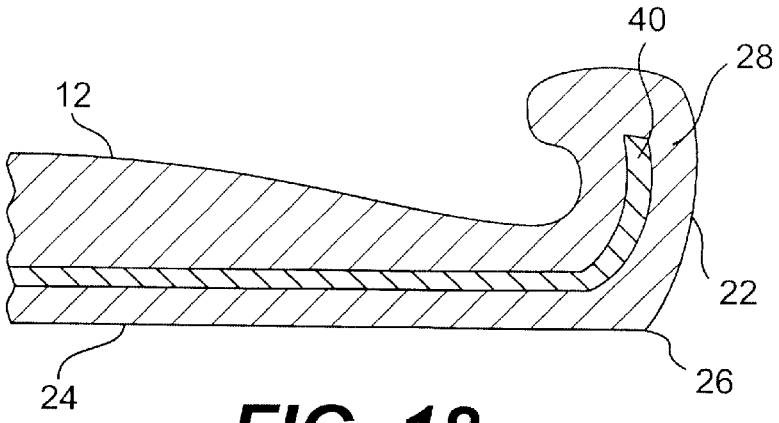
FIG. 18 shows a partial cross-sectional view of an alternate embodiment of the present invention.
Figure 19:
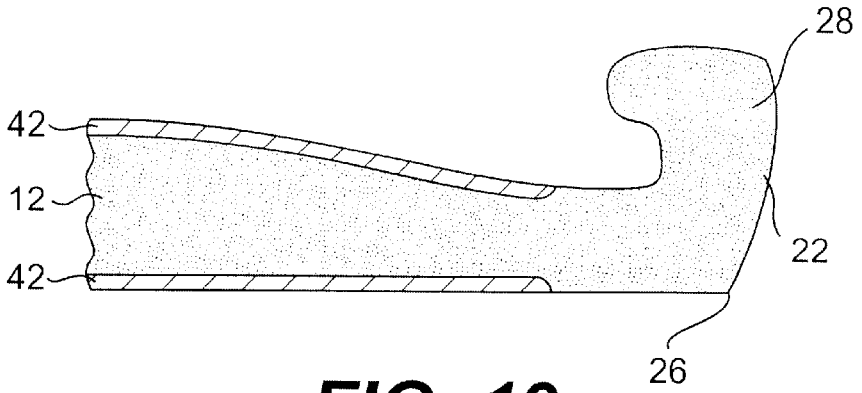
FIG. 19 shows a partial cross-sectional view of an alternate embodiment of the present invention.
Figure 20:
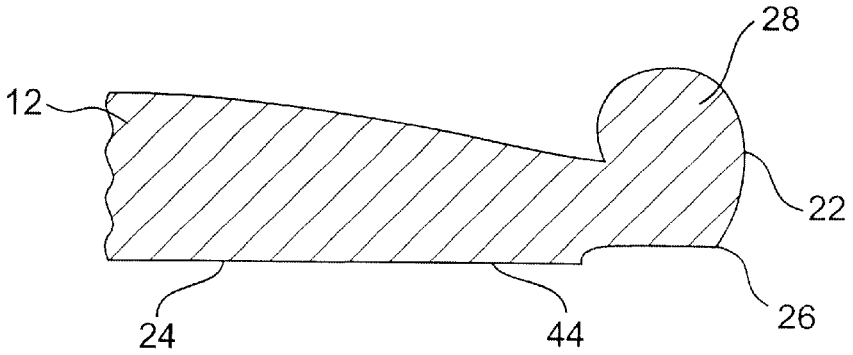
FIG. 20 shows a partial cross-sectional view of an alternate embodiment of the present invention.

FIG. 11 shows an embodiment having a rigid body 12 and a soft, flexible grip handle 28. FIG. 12 shows an embodiment with a rigid body 12 having a soft flexible outer covering 32 and a soft, flexible grip handle 28. FIG. 13 shows an embodiment in which the device mainly consists of soft, flexible material and which includes a central stiffening plate 34. FIG. 14 shows an embodiment of the present invention in which the cradle 20 is less significantly indented. FIG. 15 shows an embodiment of the present invention which includes a groove 36 internal to the previously described cradle 20. FIG. 16 shows an alternate embodiment of the present invention having multiple grooves 38. FIG. 17 shows an alternate embodiment of the present invention in which the body 12 is curved over its entire upper surface. FIG. 18 shows an alternate embodiment of the present invention having a hard plate 40 which extends into the grip handle 28 and which is covered with soft, flexible material. FIG. 19 shows an alternate embodiment of the present invention in which the device consists of a soft, flexible material and in which the body 12 is covered by a rigid casing 42. FIG. 20 shows an alternate embodiment of the present invention having an alternate grip handle 28 design and an added offset surface step on the lower surface of the disk. Another alternate embodiment of the present invention (not shown) includes a spoiler on the upper surface of the device to further counteract lift produced on the device.

Many improvements, modifications, and additions will be apparent to the skilled artisan without departing from the spirit and scope of the present invention as described herein and defined in the following claims.

What is claimed is:

1. An aquatic device for skimming across the surface of a body of water comprising:

a centrally located body section;

a bridge extending from the body section;

a grip handle having an upper portion and a lower portion, and having an outer side wall and an inner side wall, extending from the bridge and located about the periphery of the device wherein the upper portion of the grip handle is at least as thick as the lower portion of the grip handle; and a convex bottom surface which extends to and intersects with the outer side wall of the grip handle.

2. An aquatic device according to claim 1 wherein the body further comprises a downwardly and outwardly ramped perimeter.

3. An aquatic device according to claim 1 wherein the bridge is thin enough to allow the bridge to bend.

4. An aquatic device according to claim 3 wherein the bridge is about 0.001 inches to 0.75 inches (0.00254 to 1.905 cm) in thickness.

5. An aquatic device according to claim 3 wherein the bridge is about 0.125 inches to 0.75 inches (0.3175 to 1.905 cm) in thickness.

6. An aquatic device according to claim 1 wherein the grip handle is between 0.1 and 1.5 inches (0.254 and 3.81 cm) in both thickness and in height.

7. An aquatic device according to claim 1 wherein grip handle is between 0.5 and 1.5 inches (1.27 and 3.81 cm) in both thickness and in height.

8. An aquatic device according to claim 1 wherein the grip handle is weighted.

9. An aquatic device according to claim 1 wherein the outer side wall is convex.

10. An aquatic device according to claim 9 wherein the outer side wall has a radius of between about 0.5 and 5 inches (1.27 and 12.7 cm).

11. An aquatic device according to claim 1 wherein the bottom surface has a parabolic radius of at least about 50 inches (127 cm).

12. An aquatic device according to claim 1 wherein the angle between the outer side wall and the bottom surface is between about 20 and 90 degrees.

13. An aquatic device according to claim 1 wherein the bottom surface is offset inwardly from the outer side wall.

14. An aquatic device according to claim 1 wherein the device ha s a width to height ratio between about 4 to 1 and 24 to 1.

15. An aquatic device according to claim 1 wherein the device is constructed from a material having a density in the range of 2 to 6 g/in$^3$ (0.122 to 0.366 g/cm$^3$).

16. An aquatic device according to claim 1 wherein the composite density of the device is between 2 and 6 g/in$^3$ (0.122 and 0.366 g/cm$^3$).

17. An aquatic device according to claim 1 wherein the convex bottom surface intersects axially with the outer side wall at a sharp angle such that the trailing edge of the device does not induce drag as the device skims across the surface of a body of water.

* * * * *